US007076888B2

(12) United States Patent
Damen et al.

(10) Patent No.: US 7,076,888 B2
(45) Date of Patent: Jul. 18, 2006

(54) FREEZE DRYER

(75) Inventors: Frans Damen, Langeweg (NL); Francis W. DeMarco, Niagara Falls, NY (US); Ernesto Renzi, Youngstown, NY (US)

(73) Assignee: The BOC Group, PLC, Winlesham (GB)

( * ) Notice: Subject to any disclaimer, the term of this patent is extended or adjusted under 35 U.S.C. 154(b) by 0 days.

(21) Appl. No.: 10/796,943

(22) Filed: Mar. 10, 2004

(65) Prior Publication Data

US 2005/0198856 A1 Sep. 15, 2005

(51) Int. Cl.
*F26B 13/30* (2006.01)

(52) U.S. Cl. ..... 34/92

(58) Field of Classification Search ..... 34/92, 34/283; 217/109; 414/935
See application file for complete search history.

(56) References Cited

U.S. PATENT DOCUMENTS

| | | | | |
|---|---|---|---|---|
| 1,963,089 | A | 6/1934 | Henderson | |
| 2,244,405 | A | 6/1941 | Schilling, Jr. | |
| 2,322,377 | A | 6/1943 | McHarg | |
| 3,469,327 | A | 9/1969 | Janovtchik et al. | |
| 3,768,203 | A | 10/1973 | Bellucci | |
| 4,624,512 | A | 11/1986 | Fay | |
| 4,932,160 | A | 6/1990 | Sperko | |
| 5,892,200 | A * | 4/1999 | Kendall et al. | 219/201 |
| 6,392,182 | B1 * | 5/2002 | Hosaka | 219/69.11 |

FOREIGN PATENT DOCUMENTS

| | | | |
|---|---|---|---|
| DE | 295 01 564 | U1 | 3/1995 |
| DE | 297 19 623 | U1 | 12/1997 |
| EP | 0 429 813 | A1 | 6/1991 |
| EP | 0 773 418 | A1 | 5/1997 |
| FR | 726 863 | A | 6/1932 |
| FR | 2 780 148 | A | 12/1999 |
| JP | 63-312574 | A | 12/1988 |

OTHER PUBLICATIONS

R. Battenberg, W. Alexander; Abstract of EP 0 773 418 entitled Door for Autoclaves, Freeze Drying Plants, Autoclavable Freeze Drying Plants, etc.; dated May 14, 1997;.
WPI abstract accession No. 1997-261402/24.
J. Futagawa; Abstract of JP 63-312574 entitled Gate Valve Device of Vacuum Device, dated Dec. 21, 1988; Patent Abstracts of Japan.
United Kingdom Patent Office Search Report Application No. GB0407078.5; Date of search: Aug. 17, 2004.
International Search Report of International Application No. PCT/GB2005/000665; Date of mailing of the International Search Report: Jun. 22, 2005.

* cited by examiner

*Primary Examiner*—S. Gravini

(57) ABSTRACT

A freeze dryer comprising a chamber having a rectangular slot through which vials are inserted into the chamber, and a slot door for forming a seal with the chamber to close the slot. To enable the vials to be subsequently removed from the chamber, the slot door is raised. As the door is raised, it is rotated to expose the rear surface of the door for cleaning purposes.

17 Claims, 6 Drawing Sheets

FREEZE DRYER

FIELD OF THE INVENTION

The present invention relates to freeze dryers and the like, and more particularly to enclosures for freeze dryers.

BACKGROUND OF THE INVENTION

Freeze dryers typically incorporate a pressure vessel having a freeze drying chamber for receiving a plurality of containers or vials containing sterile material to be freeze dried. Access to the chamber for automated loading and removal of vials is through a rectangular opening, or slot, formed in a wall or in the main door of the chamber. The slot is closed by a slot door which, with the chamber, forms a vacuum seal around the slot. To enable vials to be inserted into and removed from the chamber, the slot door is vertically raised relative to the slot by moving the slot door along guide tracks.

Maintaining sterile conditions within the dryer requires periodic cleaning and sterilization of the slot door and guide tracks. In order to access the rear surface of the slot door, that is, the surface of the slot door which faces the chamber, it is necessary to manually remove the slot door from the guide tracks, thereby increasing the cost and duration of the cleaning and sterilization.

SUMMARY OF THE INVENTION

In a first aspect, the present invention provides a slot door assembly for a freeze dryer or the like, the assembly comprising a slot door for closing a slot formed in a chamber of the dryer, means for moving the door in a direction transverse to the slot to permit access to the chamber, and means for rotating the door as it is moved transverse to the slot.

By causing the slot door to rotate as it is moved away from the slot, the rear surface of the slot door is exposed to allow manual or automatic cleaning and sterilization of the rear surface without the need to remove the door from the dryer.

In a preferred arrangement, the rotating means comprises a cam attached to the door for engaging a curved guide to cause the door to rotate. The guides are preferably in the form of tracks provided on facing side walls of the dryer.

The moving means preferably engages or is connected to a pivot of the door. Two pivots may be provided, one on either side of the door, each being associated with a respective cam and guide.

The rotating means may be arranged to rotate the door during movement thereof from a closed position, so that the door is gradually rotated as the slot is opened. Alternatively, in a preferred arrangement the moving means is arranged to move the door from the closed position to a second open position at which the cam engages the guide, the slot being preferably fully exposed by the door at the second position. Means may be provided for automatically stopping the moving means at the second position. This can enable the door to be stopped at the second position to enable containers or vials to be inserted in and removed from the chamber with minimal disturbance of air flow by the slot door.

Thus, in this preferred arrangement, the door rotates during movement of the door from the second position to a third, open arrangement. Means may be provided for automatically stopping movement of the door at the third position. The means for stopping the door in the second and third positions may be provided by sensors or switches located at these positions for detecting the presence of the moving means, the sensors being arranged to output signals to a controller for controlling the moving means.

Each cam is preferably attached to an arm connected at one end thereof to the pivot, and preferably comprises a roller rotatably mounted on the arm.

Each pivot is preferably connected to the door at or towards one end thereof so as to cause the other end of the door to swing away from the chamber as the door is moved away from the slot. The moving means preferably engages or is connected to the pivot. For example, the pivot may pass through an aperture formed in the moving means.

The moving means preferably comprises means for raising and lowering the door, and may include means for isolating at least part of the moving means from the ambient atmosphere.

In a second embodiment of the present invention, there is provided a freeze dryer comprising a chamber, a slot formed in the chamber for providing access to the chamber, and a slot door assembly as aforementioned.

BRIEF DESCRIPTION OF THE DRAWINGS

The present invention will now be described with reference to the accompanying drawings, in which.

DETAILED DESCRIPTION OF THE INVENTION

Figure 1:
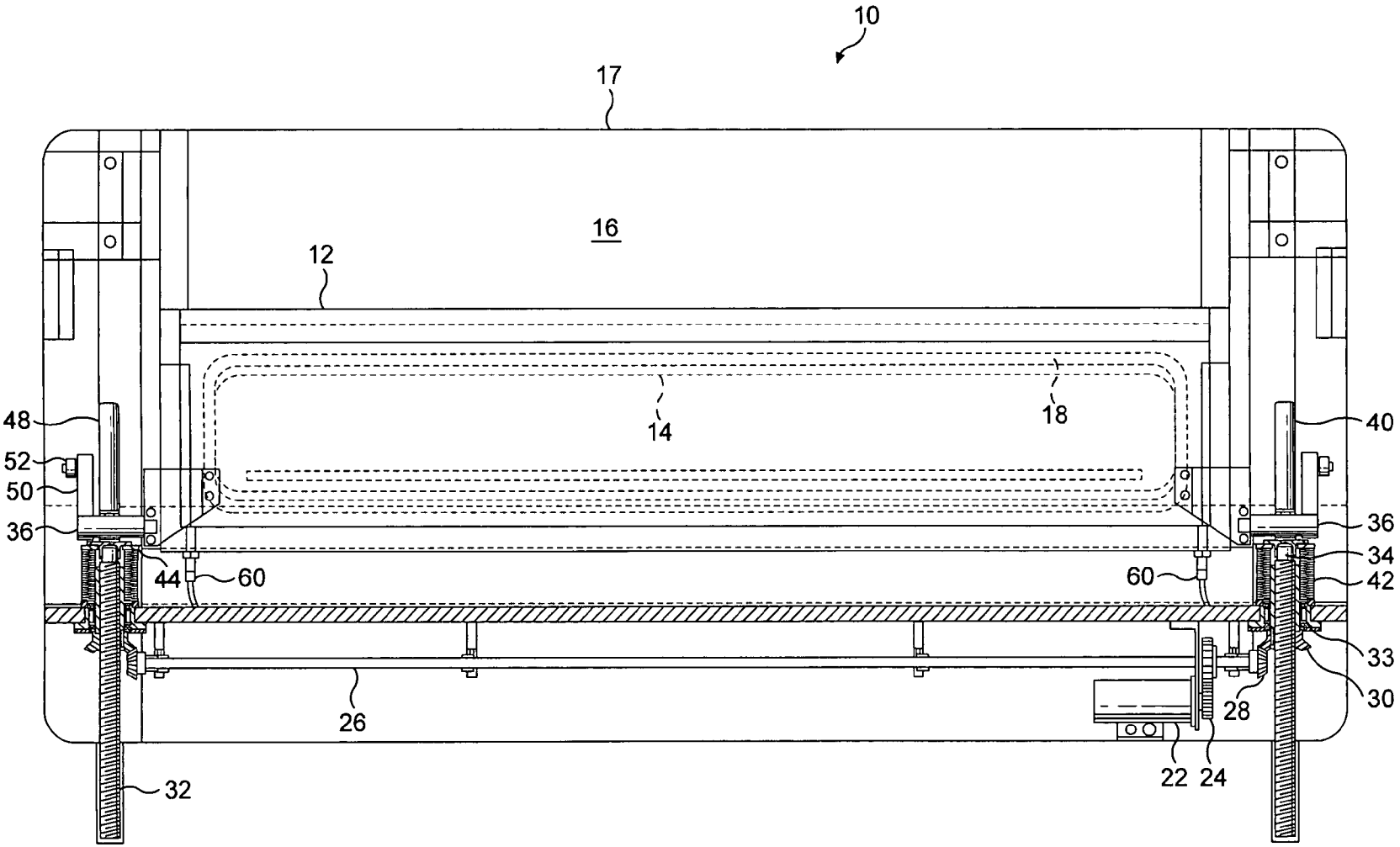
FIG. 1 is a front view, partially in section, of a door assembly, with the door in a first, closed position.
Figure 2:
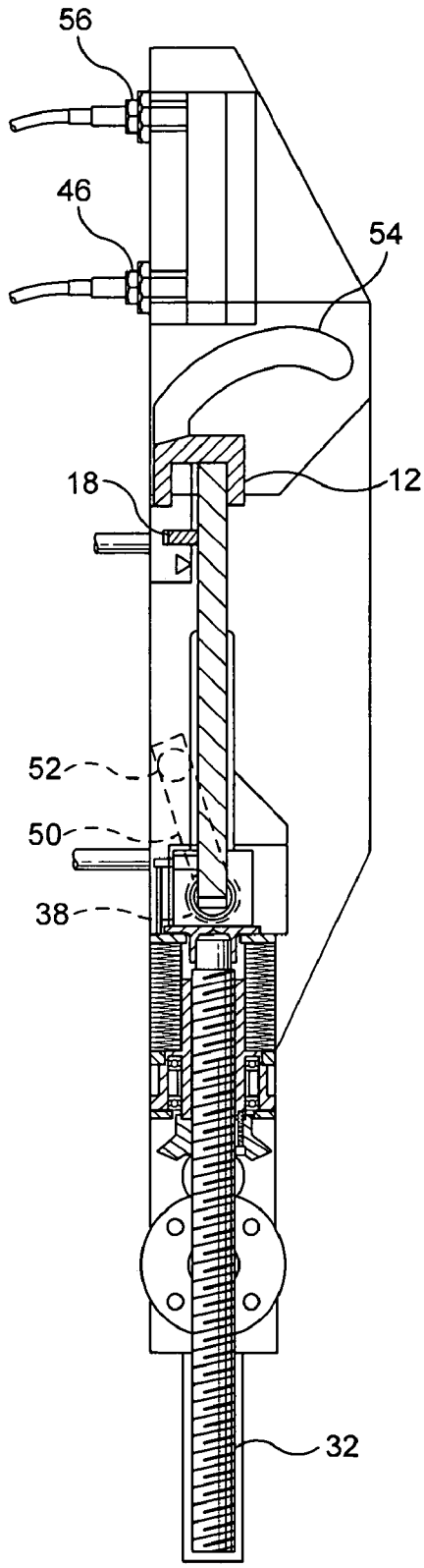
FIG. 2 is a side view, partially in section, of the door assembly as shown in FIG. 1.
Figure 5:
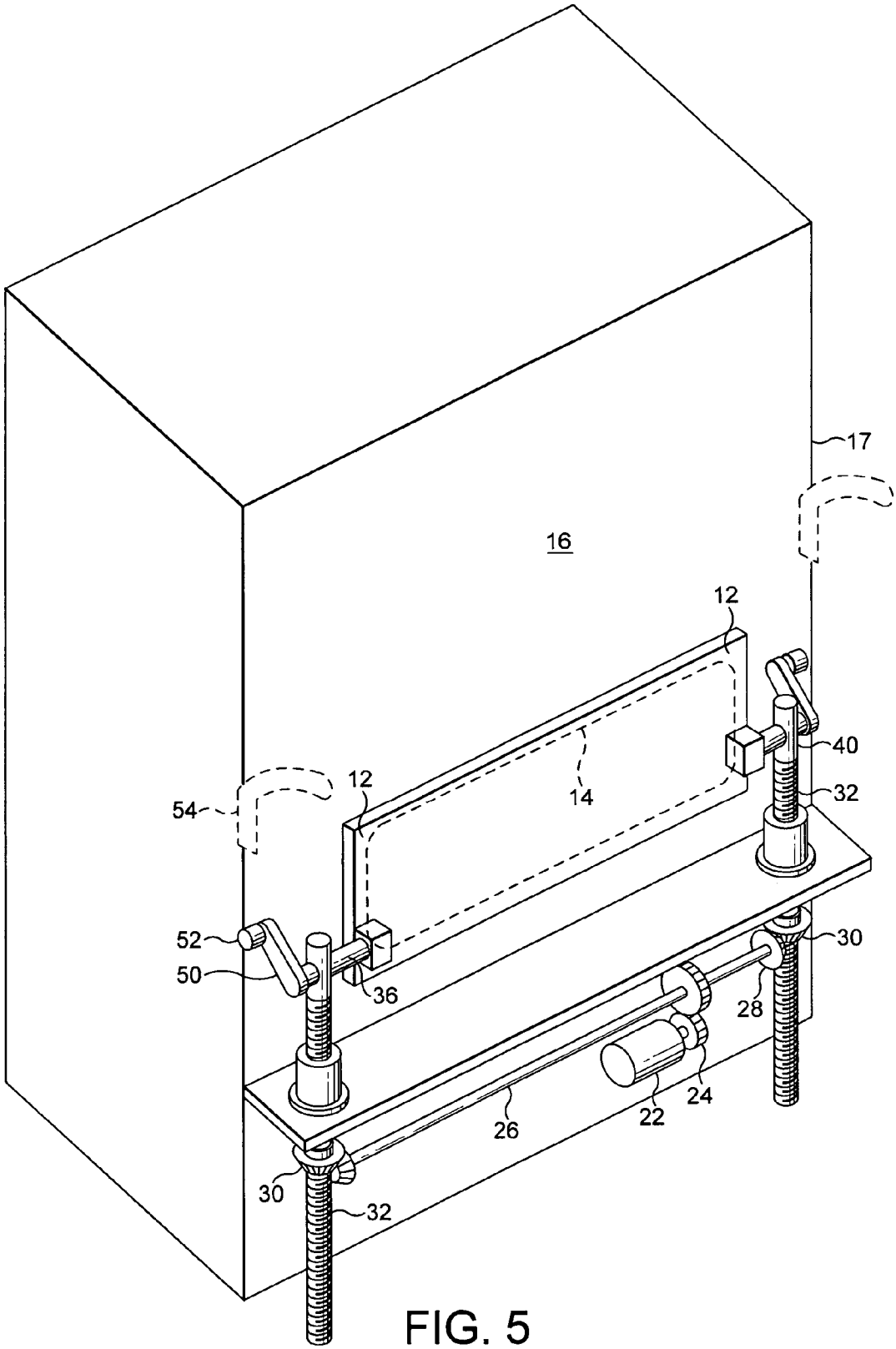
FIG. 5 is a perspective view of an embodiment of a freeze dryer incorporating the door assembly of FIG. 1, with the door in the closed position.

With reference to FIGS. 1 and 2, an embodiment of a slot door assembly 10 comprises a rectangular slot door 12 for closing a slot 14 formed in a wall or main door of a chamber 16 of a freeze dryer 17 or the like. FIGS. 1, 2 and 5 illustrate the door 12 in a closed position, in which the door 12 engages a sealing arrangement 18 extending around the slot 14 to form a vacuum seal.

The assembly 10 includes a moving mechanism 20 for raising the door to enable containers or vials to be inserted into and removed from the chamber 16 through the slot 14. The moving mechanism 20 comprises an AC/DC drive motor 22 connected by a timing belt or gear assembly 24 to a drive shaft 26. Gear wheels 28 attached to the ends of the drive shaft 26 intermesh with gear wheels 30 each located on a respective lead screw 32, the lead screws 32 being provided on respective sides of the assembly 10 and supported by bearings 33. Each lead screw 32 may be a normal thread lead screw or a ball screw spindle, depending on the required speed at which the slot door 12 is to be raised and lowered. In this embodiment, the slot door 12 is raised and lowered at a rate of around 125 mm per second.

The upper end 34 of each lead screw 32 engages a pivot pin 36 attached to a side of the slot door 12. In the arrangement shown in FIGS. 1 and 2, each pin 36 passes through an aperture 38 formed in a cylindrical member 40 located on the upper end of the lead screw 32.

Figure 3:
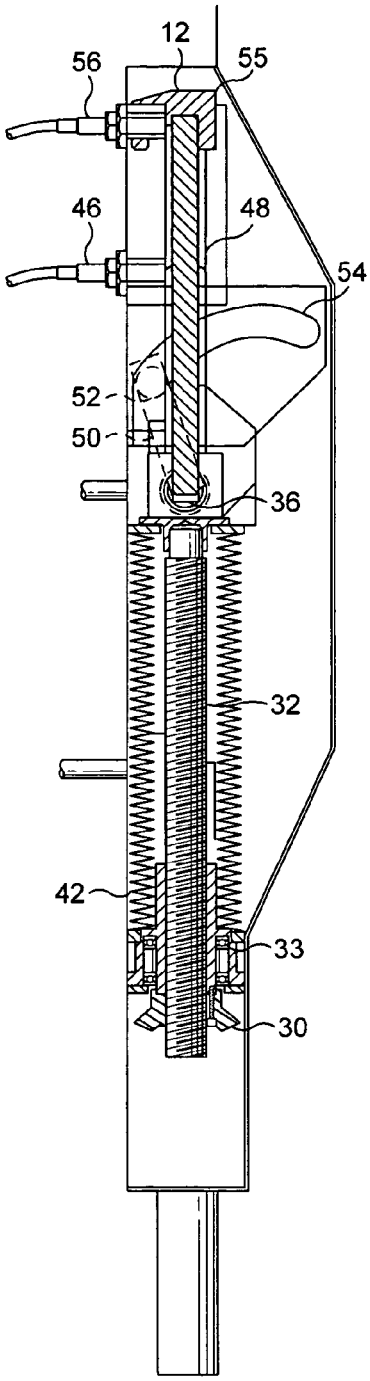
FIG. 3 is a similar view to FIG. 2, with the door in a second, open position.
Figure 6:
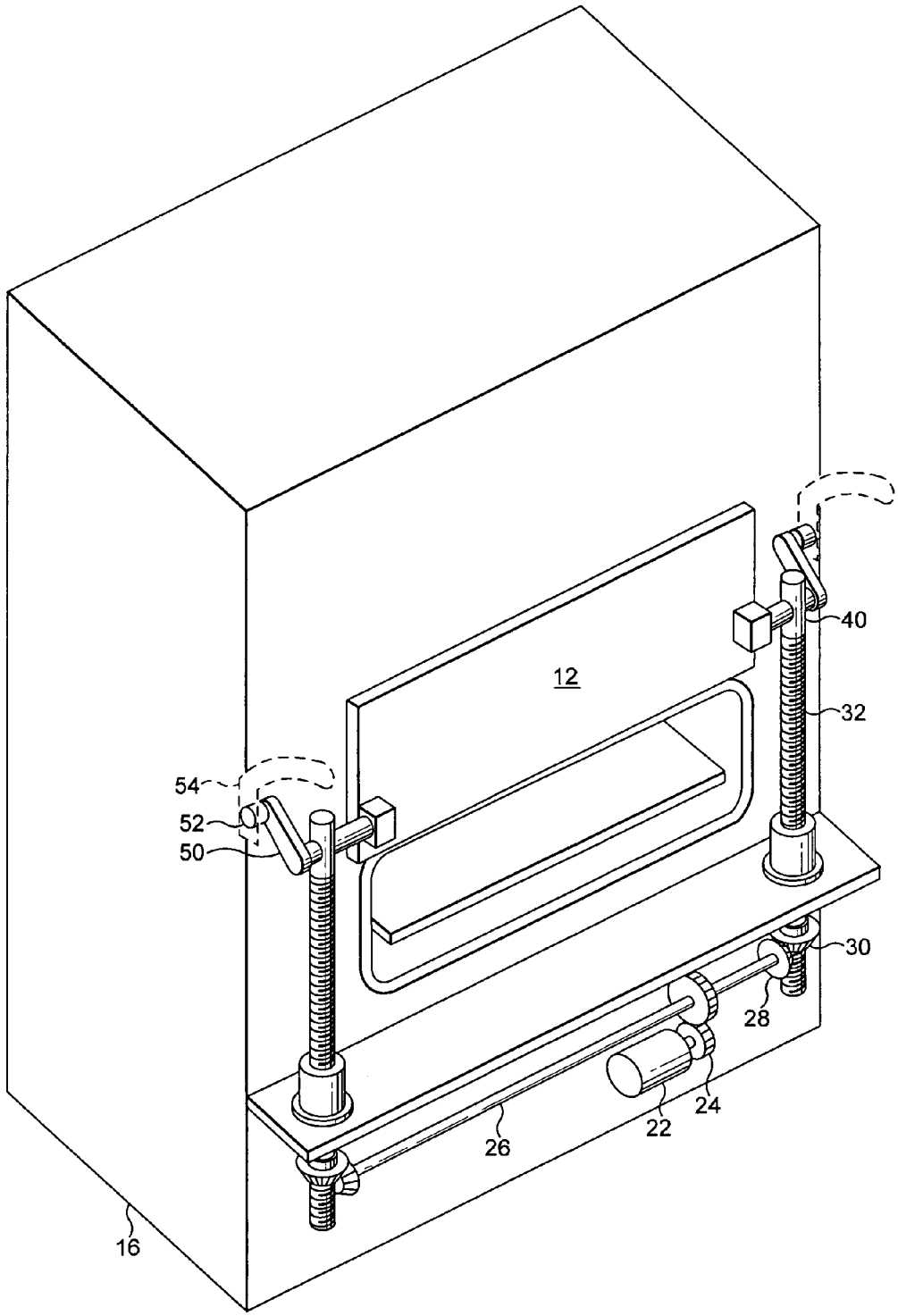
FIG. 6 is a perspective view of the dryer of FIG. 5, with the door in the second position.

To move the slot door 12 from the closed position shown in FIG. 2 to an open, loading position as shown in FIGS. 3 and 6, the motor 22 is operated to cause the drive shaft 26 to rotate in a first direction. Rotation of the gear wheels 28, 30 draws the lead screws 32 upwards, which in turn move the cylindrical members upwards to raise the slot door 12, thereby exposing the slot 14.

As illustrated in FIGS. 1 to 3, each lead screw 32 is isolated from the ambient atmosphere, and thus from the surrounding sterile environment, by a surrounding bellows 42. One end of the bellows 42 is attached to the base 44 of the cylindrical member 40, and the other end of the bellows is fixed proximate the bearings 33 so that the bellows 42 expands as the slot door 12 is raised. Raising of the slot door 12 to the loading position shown in FIG. 3 is detected by a first sensor or switch 46, which detects the presence of the upper end 48 of the cylindrical member 40 relative thereto. An output of the first switch 46 is fed to a controller (not shown), which may be arranged to stop the motor 22 once the slot door 12 is in the loading position to enable vials to be inserted into and removed from the chamber 16. In the case of laminar air flow, the disturbance of the air flow is minimal during loading of the chamber 16.

As shown in FIGS. 1 to 3, the assembly 10 further comprises support arms 50, each support arm 50 being connected at one end thereof to a respective pivot pin 36. A cam roller 52 is rotatably mounted to the other end of each support arm 50. In the loading position, each cam roller has just engaged a respective cam track 54 located on a respective side wall of the chamber 16. Each cam track is curved such that, with further raising of the slot door 12 from the loading position, the slot door 12 is caused to pivot about pivot pins 36 as the cam rollers 52 follow the cam tracks 54, moving the upper end 55 of the slot door 12 away from the chamber 16.

Figure 4:
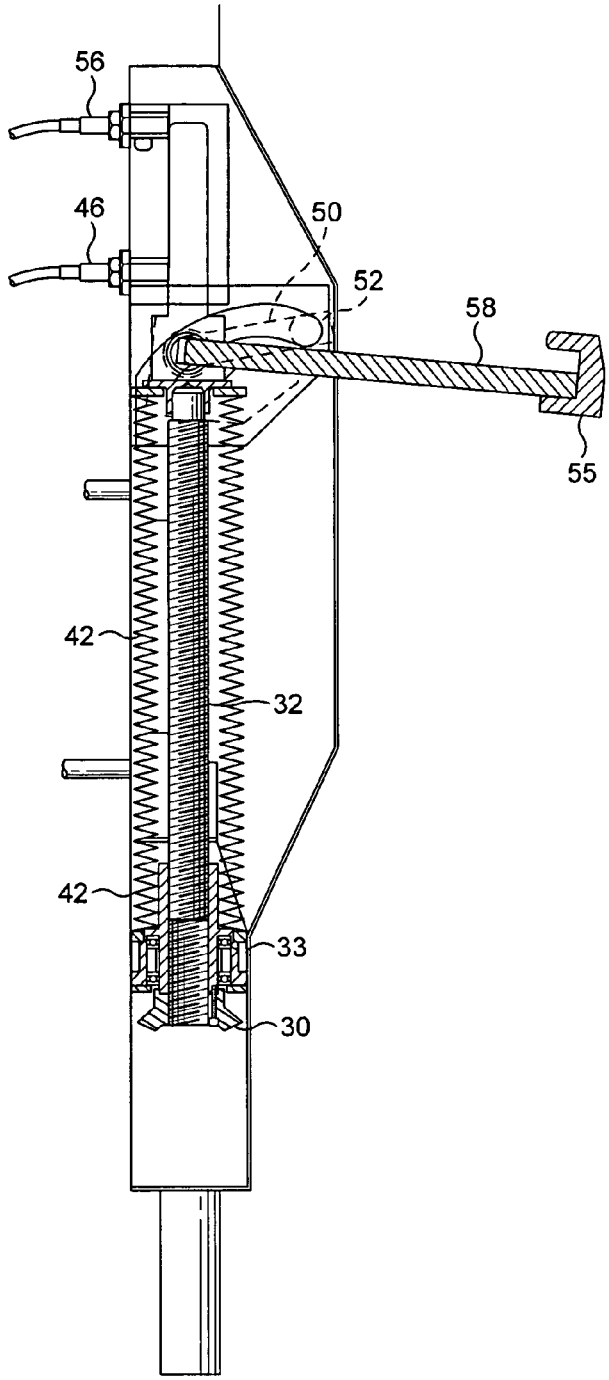
FIG. 4 is a similar view to FIG. 2, with the door in a third, open position.

A second sensor or switch 56 is located above the first switch 46. Similar to the first switch 46, the second switch 56 detects the presence of the upper end 48 of the cylindrical member 40 relative thereto, and outputs a signal to the controller to stop the motor 22 when the door 12 is in the open, cleaning position shown in FIGS. 4 and 7. In this cleaning position, the slot door 12 is supported by the pivot pins 36 and cam rollers 50, and the rear surface 58 of the slot door is exposed, thereby enabling substantially the whole door to be manually or automatically cleaned and sterilized. Cleaning and sterilization may be automatically performed on a periodic basis, for example, every few days.

Figure 7:
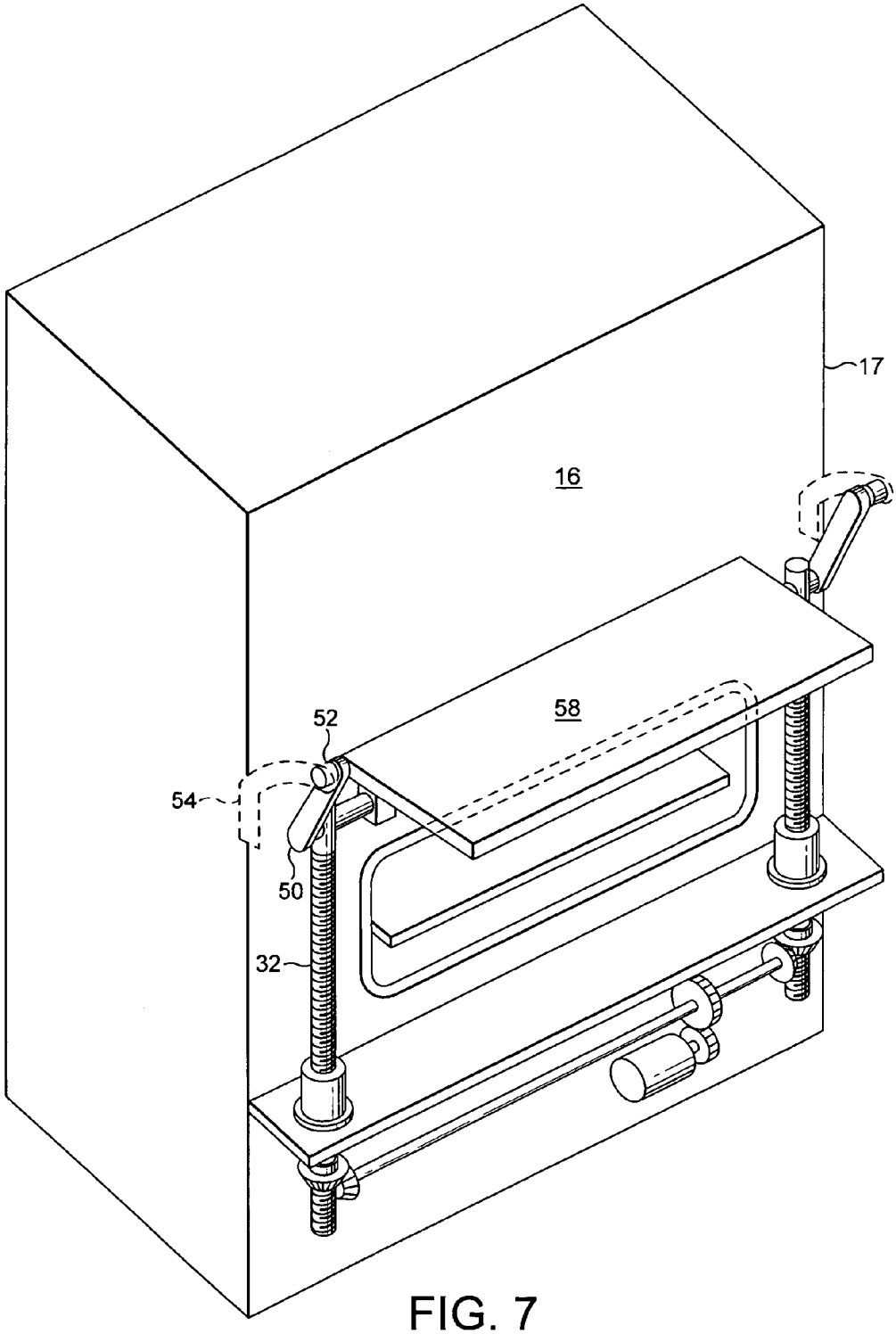
FIG. 7 is a perspective view of the dryer of FIG. 5, with the door in the third position.

The slot door may be moved in a single movement from the closed position shown in FIG. 5 to the cleaning position shown in FIG. 7, or alternatively may be moved first to the loading position shown in FIG. 6, and from there to the cleaning position.

Following completion of the slot door cleaning and sterilization, the motor 22 is operated in reverse to lower the slot door 12. Third sensors or switches 60 are provided to detect the location of the slot door 12 in the closed position shown in FIG. 1, and to output signals to the controller to stop the motor 22.

In the embodiment shown in FIGS. 1 to 7, the moving mechanism 20, which includes the motor 22, drive shaft 26 and associated gears are located towards the base of the freeze dryer. However, the moving mechanism 20 may alternatively be located towards the top of the freeze dryer to raise and lower the slot door 12 as required. In another alternative, the moving mechanism 20 may be physically isolated from the freeze dryer. For example, the mechanism 20 may be located in a technical area divided from the sterile environment of the freeze dryer.

Furthermore, whilst in the preferred embodiment the slot door 12 is raised from the closed position to expose the slot 14, the slot door may alternatively be lowered, moved sideways or in any other direction transverse to the slot to expose the slot 14.

In summary, a freeze dryer comprises a chamber having a rectangular slot through which vials are inserted into the chamber, and a slot door for forming a seal with the chamber to close the slot. To enable the vials to be subsequently removed from the chamber, the slot door is raised. As the door is raised, it is rotated to expose the rear surface of the door for cleaning purposes.

While the foregoing description and drawings represent the preferred embodiments of the present invention, it will be apparent to those skilled in the art that various changes and modifications may be made therein without departing from the true spirit and scope of the present invention.

The invention claimed is:

1. A slot door assembly for a freeze dryer comprising:

a slot door for covering a slot formed in the freeze dryer, the slot door comprising an inner side facing the slot;

a moving mechanism connected to the slot door for vertically moving the slot door from a closed position to an open position; and a rotating mechanism connected to the slot door for rotating the slot door from an open position to a cleaning position, thereby exposing the inner side of the slot door.

2. The slot door assembly of claim 1 wherein the moving mechanism comprises a drive motor.

3. The slot door assembly of claim 2 wherein the moving mechanism further comprises a gear assembly connected to the drive motor.

4. The slot door assembly of claim 3 wherein the moving mechanism further comprises a drive shaft connected to the drive motor and wherein a first end of the drive shaft is connected to a plurality of first gear wheels and wherein a second end of the drive shaft is proximate to a plurality of second gear wheels.

5. The slot door assembly of claim 4 wherein the moving mechanism further comprises a first lead screw positioned on one of the first gear wheels and a second lead screw positioned on one of the second gear wheels.

6. The slot door assembly of claim 5 wherein the moving mechanism further comprises a first pivot pin connected to the slot door and positioned to engage the first lead screw and a second pivot pin connected to the slot door and positioned to engage the second lead screw.

7. The slot door assembly of claim 1 wherein the rotating mechanism comprises a cam mechanism.

8. The slot door assembly of claim 7 wherein the cam mechanism comprises a cam roller connected to the slot door and positioned to engage a cam track.

9. The slot door assembly of claim 8 wherein the cam track is curved.

10. The slot door assembly of claim 1 further comprising a controller for moving and rotating the slot door.

11. The slot door assembly of claim 10 further comprising a first sensor positioned to detect the slot door in the closed position, wherein the first sensor outputs a first signal to the controller.

12. The slot door assembly of claim 10 further comprising a second sensor positioned to detect the slot door in the open position, wherein the second sensor outputs a second signal to the controller.

13. The slot door assembly of claim 10 further comprising a third sensor positioned to detect the slot door in the cleaning position, wherein the third sensor outputs a third signal to the controller.

14. The slot door assembly of claim 8 wherein the cam roller engages the cam track when the slot door is in the open position.

15. The slot door assembly of claim 1 wherein the slot door moves from the closed position to the cleaning position in a single movement.

16. The slot door assembly of claim 1 wherein the moving mechanism comprises a lead screw for moving the slot door between the closed position and the open position.

17. The slot door assembly of claim 1 wherein the moving mechanism comprises a lead screw for moving the slot door between the closed position and the cleaning position.

* * * * *

UNITED STATES PATENT AND TRADEMARK OFFICE

CERTIFICATE OF CORRECTION

PATENT NO. : 7,076,888 B2
APPLICATION NO. : 10/796943
DATED : July 18, 2006
INVENTOR(S) : Frans Damen, Francis W. DeMarco and Ernesto Renzi It is certified that error appears in the above-identified patent and that said Letters Patent is hereby corrected as shown below:

On the title page, item (73) should read as follows:

Assignee: The BOC Group, PLC Windlesham

Attorney, Agent, or Firm - Bernard Lau, Ira Zebrak

Signed and Sealed this

Twelfth Day of August, 2008

JON W. DUDAS
*Director of the United States Patent and Trademark Office*